United States Patent [19]

Kannegiesser et al.

[11] Patent Number: 4,519,222

[45] Date of Patent: May 28, 1985

[54] DEVICE FOR SMOOTHING GARMENTS

[75] Inventors: Martin Kannegiesser; Klaus Müssiger, both of Bad Salzuflen; Wilfried Dreischmeier, Vlotho, all of Fed. Rep. of Germany

[73] Assignee: Herbert Kannegisser GmbH & Co., Vlotho, Fed. Rep. of Germany

[21] Appl. No.: 502,408

[22] Filed: Jun. 8, 1983

[30] Foreign Application Priority Data

Jun. 12, 1982 [DE] Fed. Rep. of Germany ..... 3222199

[51] Int. Cl.[3] ..... D06B 3/30; D06B 23/00

[52] U.S. Cl. ..... 68/5 C; 34/82; 55/430; 68/5 E; 68/18 F; 68/20

[58] Field of Search ..... 68/5 C, 5 D, 18 F, 20, 68/5 E; 34/82; 223/70, 73, 76; 55/290, 351, 354, 430

[56] References Cited

U.S. PATENT DOCUMENTS

| | | | |
|---|---|---|---|
| 1,361,626 | 12/1920 | Schwartz et al. | 55/290 X |
| 2,925,664 | 2/1960 | Cobb et al. | 55/354 X |
| 2,996,810 | 8/1961 | Cobb et al. | 34/82 |
| 3,375,638 | 4/1968 | Dungler | 55/351 X |
| 3,683,651 | 8/1972 | Mazza | 68/20 |
| 3,849,815 | 11/1974 | Frauendorf | 68/5 C X |
| 3,902,455 | 9/1975 | Lehmann et al. | 55/351 X |
| 4,153,008 | 5/1979 | Marino et al. | 55/351 X |
| 4,257,345 | 3/1981 | Brice | 55/351 X |

FOREIGN PATENT DOCUMENTS

| | | | |
|---|---|---|---|
| 658728 | 10/1951 | United Kingdom | 68/5 C |

*Primary Examiner*—Philip R. Coe

*Attorney, Agent, or Firm*—Sughrue, Mion, Zinn, Macpeak & Seas

[57] ABSTRACT

Smoothing washed garments (10) in the treatment chamber (11) of a finisher produces a considerable amount of fluff. To remove the fluff from the device in a trouble-free and effective manner the flowing medium carrying the fluff along is passed through a sieve belt (20) which conveys the fluff out of the device. Outside the treatment chamber (11) the fluff is removed in a suitable manner.

7 Claims, 5 Drawing Figures

DEVICE FOR SMOOTHING GARMENTS

DESCRIPTION

Figure 1:
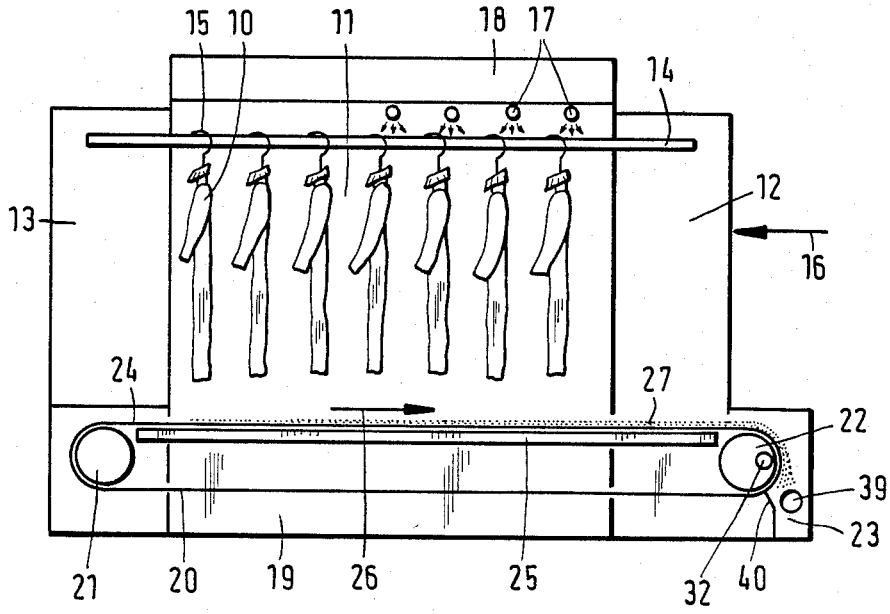

The invention relates to a device for smoothing garments, in particular for the simultaneous drying and smoothing of washed garments, by means of flowing media, such as steam and hot air, in a treatment chamber through which the textiles are conveyed and which has a sieve, a filter or the like through which the flowing media flow after treatment of the textiles and which is arranged to be mobile to remove fluff and the like.

Devices of this type are referred to in the industry as finishers. In these, the garments hang on coat hangers as they are conveyed by means of a transport device through the treatment chamber, which is usually designed in the form of a tunnel. Steam and hot air or steam-containing hot air are or is directed within the treatment chamber from above onto the garments to carry out the treatment. The steam-containing hot air streams leaving the treatment chamber are passed through a sieve arranged in the bottom part of the treatment chamber and fluff is filtered out of the stream.

The effectiveness of these treatment devices results in a considerable amount of fluff on or near the sieve. To ensure that the device remains in working order, it is necessary to remove the fluff relatively frequently, for example several times per day.

To facilitate this above cleaning step it has already been proposed to divide the sieve into two contiguous fluff sieves which, one at each end of the device, can be pulled like drawers out of the device to be cleaned or have the fluff removed. ("Jet-Finisher" from VFA).

Removing the fluff generally necessitates the treatment process to be interrupted and hence reduces production. Furthermore, the necessary work cannot be carried out by the predominantly unskilled operating personnel, but works mechanics have to be used for this work. Besides, the cleaning step is time-consuming.

The object of the invention is to propose such a device for smoothing garments as simplifies the removal of fluff, in particular makes it possible to remove fluff without interrupting the treatment process or having to employ special, additional personnel.

This object is achieved when the device of the invention is characterised in that the sieve, the filter or the like is embodied as a conveyor belt (sieve belt) leading out of the treatment chamber.

The sieve belt of the invention, upon which the fluff deposits in the course of the treatment, is periodically or continuously moved, so that the fluff is conveyed out of the treatment chamber without the treatment process having to be interrupted, since at the rate at which fluff-covered sieve belt is moved out of the treatment chamber cleaned sieve belt is moved into the treat-. ment chamber.

Outside the treatment chamber the fluff-covered sieve belt (carpet of fluff) is cleaned, i.e. freed from the fluff. This cleaning can be carried out in various ways by mechanical and/or pneumatic cleaning units.

In one illustrative embodiment, the fluff is lifted off the sieve belt by compressed air from the side of the sieve belt opposite to the fluff. This "blowing off" of the fluff can take place in the region of a reversing roll for the sieve belt. The fluff can be collected in a receiving vessel and/or be taken away by a suction unit.

In another embodiment of the invention, the sieve belt has assigned to it outside the treatment chamber a suction unit which, with a suction nozzle, is arranged above the sieve belt and which removes, by sucking, the fluff conveyed out of the treatment chamber.

According to the invention, the sieve belt can be a continuous belt which is guided over reversing rolls outside the treatment chamber. In this case, the carrying run of the sieve belt forms the surface onto which the fluff deposits. An alternative proposal is for a finite sieve belt which is unwound from one winding drum outside the treatment chamber and wound onto another winding drum. The drive motion for the sieve belt is reversible in this case. When the sieve belt has been unwound from one winding drum and cleaned it is conveyed back in the reverse direction of motion.

In a further proposal of the invention, the finite sieve belt can be wound up (with the carpet of fluff in place), be taken out of the device and be replaced by another, second, fluff-free sieve belt. In this case, the sieve belt is cleaned outside the treatment device.

Figure 2:
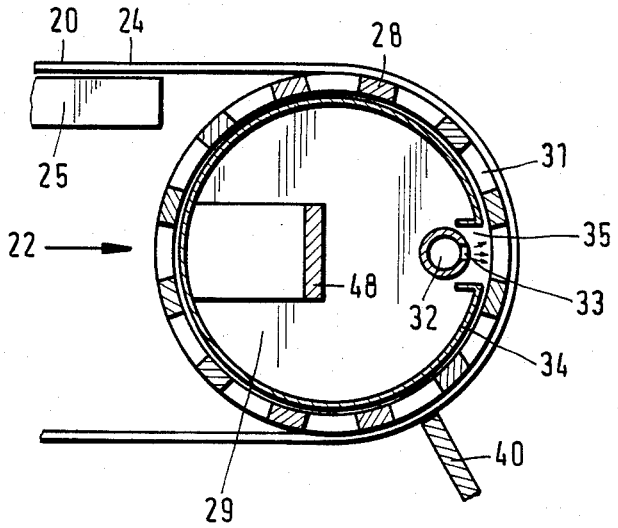
Figure 3:
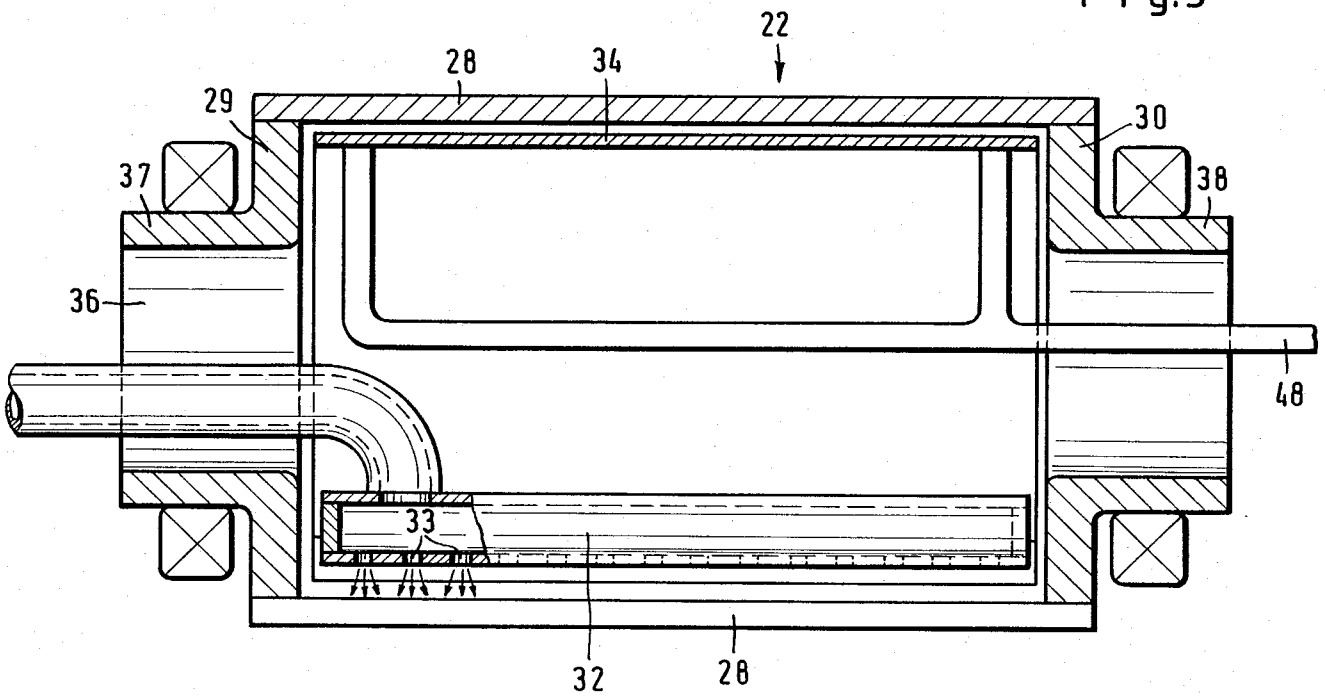
Figure 4:
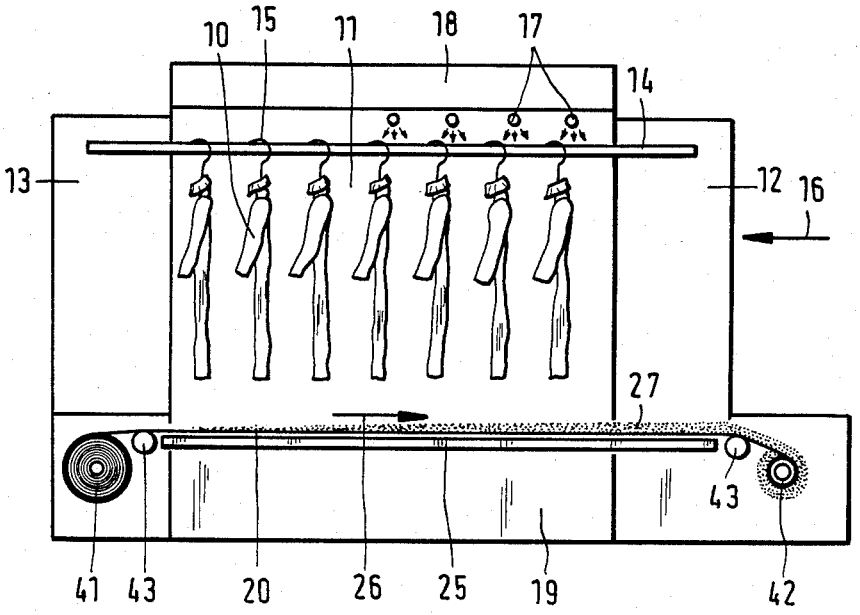
Figure 5:
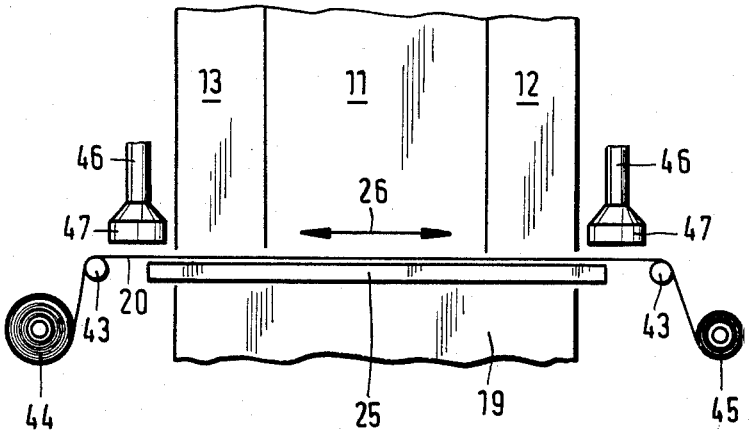

More detail is explained below by means of illustrative embodiments of the invention which are depicted in drawings, in which FIG. 1 is a diagrammatic longitudinal section through a sieve belt device for treating garments, FIG. 2 shows in section a magnified detail of the device of FIG. 1, namely a reversing roll for the sieve belt, FIG. 3 shows a further magnified axial section through the reversing roll of FIG. 2, FIG. 4 depicts, in analogy to FIG. 1, another illustrative embodiment of the invention, and FIG. 5 is a longitudinal section through or a side view of a detail (sieve belt) of a further illustrative embodiment.

The drawings are merely diagrams of the device for treating garments 10. In the illustrative embodiments of FIG. 1 and FIG. 4 the interior of the device is divided into three zones, namely into an elongated, tunnel-like treatment chamber 11 and ahead and behind thereof in transport direction, into respectively a garment-entry chamber 12 and a garment-exit chamber 13. The garments 10 hang from coat hangers 15 as they are conveyed through the chambers 12, 11 and 13, i.e. in the direction of arrow 16, by a transport device 14, for example a screw conveyor.

Inside the treatment chamber 11, steam and hot air, preferably in the form of steam-containing hot air, is or are directed from above onto the garments 10. For this purpose, steam supply lines which are shown in the drawings in diagrammatic form, namely steam pipes 17 with outlet nozzles directed downwards and hot air ducts 18 are arranged in the upper part of the treatment chamber 11, at any rate above the garments 10. In the lower part of the device or the treatment chamber 11, there is formed a medium-collecting chamber 19 into which the steam-containing hot air stream enters.

The steam and the hot air are pumped around in a closed cycle within the device as exit air is conducted away and fresh air is added. For simplicity this circulation system has not been depicted in detail.

Before entry into the medium-collecting chamber 19, the circulating, flowing medium (steam/hot air) passes through a sieve or filter area. This area has the function of separating the fluff out of the stream and collecting it.

In the illustrative example of FIG. 1, the sieve area is arranged in the form of a sieve belt 20 in the lower part of the treatment chamber 11. This sieve belt 20 can be made of metal or of a suitable, namely steam- and heat-resistant, material. It is a finely meshed grid or network or a fabric. If a metal is used, it has to be corrosion-resistant.

In the illustrative embodiment of FIG. 1, the sieve belt 20 is constructed as a continuous conveyor belt which is guided over reversing rolls 21 and 22. The reversing roll 21 is within the garment-exit chamber 13, while the reversing roll 22 is arranged outside the garment-entry chamber 12 in a receiving vessel 23 which is arranged ahead of the garment-entry chamber 12 in transport direction. The sieve belt 20 accordingly extends to the full length (and preferably the full width) of the treatment chamber 11 as well as to the full length of the garment-entry chamber 12. A carrying run 24 constitutes the actual sieve or fluff-receiving area through which the flowing medium passes. Underneath this carrying run 24 a fixed support is mounted in the form of a supporting grid 25.

In this illustrative embodiment, the sieve belt 20 can circulate continuously (at a correspondingly low speed) or intermittently in the direction of arrow 26. As a result the carrying run 24 moves in countercurrent to the direction in which the garments 10 are conveyed (arrow 16). A carpet of fluff 27 consequently forms on the carrying run 24 in decreasing thickness between the side where the garments 10 enter and the side where they leave. Most fluff is usually obtained at the entry side. The sieve belt 20 preferably has a mechanical drive (namely an electrical motor with adjustable drive speed), but it can also be driven manually, for example by means of a winder.

The carpet of fluff 27 is uninterruptedly or periodically removed from the sieve belt 20, so that the sieve belt 20 is always free of fluff as it enters the treatment chamber (from the garment-exit chamber 13). In the illustrative example of FIGS. 1 to 3, the carpet of fluff 27 is primarily lifted from the sieve belt 20, namely the carrying run 24, by pneumatic means. For this purpose, an air jet is directed at the sieve belt 20 from the side of the sieve belt 20 which is opposite the carpet of fluff 27. This cleaning step is carried out at the reversing roll 22, which is specially constructed as a hollow roll (FIGS. 2 and 3). Individual rods 28 are arranged with parallel axes a circumference apart from each other on lateral drum discs 29 and 30. As a result the drum shell formed by the rods 28 has through-slots 31 which run in axial direction and through which the air jet can pass. In the present case, this air jet is generated within the reversing roll 22 by an air-blowing pipe 32 which extends off-centeredly adjacent to the drum shell where the sieve belt 20 is in contact with the reversing roll 22. The air jet emanating from the blowing nozzles 33 is directed against the inside of the drum shell and passes through the through-slots 31 to the underside or inner face of the sieve belt 20. The carpet of fluff 27 carried along on the opposite side is lifted by the air jet from the sieve belt 20.

To ensure that the air jet is concentrated on the predetermined area of the sieve belt 20, the reversing roll 22 has fixedly mounted on its inside a diaphragm 34 which extends at a small distance along the inside of the drum shell and prevents air escaping in this area. The diaphragm 34 forms an outlet opening 35 which extends along the length of the free interior of the reversing roll 22 directly opposite the air-blowing pipe 32. As a result the sieve belt 20 is subjected to the compressed air in a controlled and concentrated manner. As can be seen from FIG. 3, the air-blowing pipe 32 is guided axially, through a central opening 36 in the drum disc 29, into the interior and is there bent into the immediate vicinity of the drum shell. The drum discs 29, 30 are mounted on hubs 37, 38. The diaphragm 34 is similarly held in place from outside the reversing roll 22 by means of a mounting 48 introduced through the central opening 36.

The positioning of the air-blowing pipe 32 in the reversing roll 22 ensures that the carpet of fluff 27 lifted from the sieve belt 20 is guided into the receiving vessel 23, from where the fluff can be conducted away in a suitable manner. In the illustrative embodiment of FIG. 1, a suction tube 39 which extends perpendicularly, i.e. about parallel with the reversing roll 22 is arranged in the receiving vessel under the descending fluff, so that the fluff is immediately absorbed by the suction tube 39 and conducted away. However, even a simple suction tube connection will be adequate.

The air-blowing pipe 32 is followed in the present case in the conveying direction by a mechanical fluff removal element, namely a, for example sheet metal, scraper 40. This scraper ensures that no fluff is left sticking to the sieve belt.

In the illustrative embodiment of FIG. 4, the treatment device is in principle constructed in the same way as in the embodiment of FIG. 1. In this case, however, the mobile sieve belt 20 for use as a fluff capture device is constructed as finite belt. Here the sieve belt 20 is unwound from a winding drum 41 in the garment-exit chamber 13 and wound up at the other side on a winding drum 42 near the receiving vessel 23. In the present case, exact guidance of the sieve belt 20 is ensured by mounting an intermediate roll 43 ahead of the winding drum 42. Here too a supporting grid 25 is arranged underneath the sieve belt 20 in the treatment chamber 11 as well as the garment-entry chamber 12.

The sieve belt 20, with the carpet of fluff 27 still in place, is wound up on the winding drum 42. Once the entire stock of sieve belt 20 (with the carpet of fluff 27 still in place) has been collected on the winding drum 42, the drum is taken out of the device and passed on to a separate cleaning step. A (second) cleaned sieve belt on a winding drum is inserted into the device and the spot occupied by the (empty) winding drum 41 removed beforehand. The process can now be repeated in the same way using the cleaned sieve belt.

FIG. 5 shows a modification of the embodiment with finite sieve belt 20 described above. The sieve belt is alternately wound onto and off one of two winding drums 44 and 45. In this case, the sieve belt 20 is designed for a to-and-fro motion, i.e. it always remains within the device.

In this case, fluff removal elements are mounted outside the treatment chamber 11 above the sieve belt 20, and they are suction units which consist of a suction line 46 and a suction head 47. The suction head 47 extends across the full width of the sieve belt 20, so that the carpet of fluff 27 is completely removed from the sieve belt 20 by sucking at a point before the belt 20 is wound up by whichever particular winding drum, 44 or 45, is active, which in turn depends on the direction of motion. The suction units 46/47 are preferably arranged within the garment-exit chamber 13 on the one hand and within the zone of the receiving vessel 23 on the other. The suction heads 47 can be combined with a mechanical cleaning device, for example a scraper, which loosens the carpet of fluff from the sieve belt 20 for better absorption by the suction head 47 at a point which, in transport direction, is ahead of the suction head 47.

We claim:

1. A device for smoothing garments, in particular for the simultaneous drying and smoothing of washed garments, by means of flowing media, such as steam and hot air, said device comprising:

a treatment chamber (11), a first chamber (12) connected to the front of the treatment chamber (11) and opening thereto, a second chamber (13) connected to the rear of the treatment chamber (11) and opening thereto, means for conveying garments horizontally through said treatment chamber from one of said first and second chambers to the other of said first and second chambers, pipes (17) arranged in the rreatment chamber (11) above the garments (10) and having outlet nozzles for directing steam downwardly onto said garments, hot air ducts (18) arranged in the treatment chamber (11) above the garments (10), a media collecting chamber (19) arranged underneath the treatment chamber (11) for receiving the flowing media, a filter arranged between the treatment chamber 911) and the media collecting chamber (19), said filter constituting a sieve belt (20), said sieve belt (20) extending over the full length and width of the treatment chamber (11) and over the full length of one of said first and second chambers, reversing rolls (21, 22) operatively mounted for rotation about their axes and positioned outside of the media collecting chamber (19), said sieve belt (20) being conducted over the reversing rolls, such that a carrying run (24) of the sieve belt (20) acts to receive a carpet of fluff (27) during device operation, means for pneumatically removing the carpet of fluff (27) from the sieve belt (20) outside of the media collection chamber (19), said means for pneumatically removing said carpet of fluff (27) comprising compressed air nozzles (32) operatively positioned in the region where the sieve belt (20) is reversed, and means for leading compressed air from the side of the sieve belt (20) opposite the fluff through said sieve the sieve belt (20) opposite the fluff through said sieve belt (20) to pneumatically remove the carpet of fluff (27) from the sieve belt (20), and a receiving vessel (23) positioned outside of said one of said first and second chambers in proximity to the reversing roll (22) and functioning to collect the fluff pneumatically removed from the sieve belt (20) outside of the media collecting chamber (19).

2. The device of claim 1, wherein the sieve belt (20) has its carrying run (24) arranged above a fixedly attached grid grid (25).

3. The device of claim 1, further comprising means for moving said sieve belt (20) continuously or periodically in a direction countercurrent to the garments (10) conveyred through the treatment chamber (11).

4. The device of claim 1, wherein at least one reversing roll (22) for the sieve belt (20) constitutes a hollow roll having a shell, through-holes (31) within said shell, and means for passing compressed air from the interior of the reversing roll (22) through the shell and through the portion of the sieve belt (20) about said hollow roll shell.

5. The device of claim 4, wherein an off-centre air-blowing pipe (32) extends parallel to the axis of the reversing roll (22), a stationary diaphragm (34) is arranged in the interior of the reversing roll (22) and includes an outlet opening (35), and said pipe includes blowing nozzles to direct by means of said blowing nozzles (33), compressed air from the inside of the reversing roll (22) onto the shell, through said outlet opening (35) of said diaphragm, and said shell is provided with through-holes (31).

6. The device of claim 1, further comprising an element for removing the fluff, said element constituting a suction tube (39), arranged in the receiving vessel such that the fluff is lifted from the sieve belt (20).

7. The device of claim 1, further comprising scrapers (40) for mechanically removing the fluff from the sieve belt (20).

* * * * *